US006779443B2

(12) United States Patent
Martinez et al.

(10) Patent No.: US 6,779,443 B2
(45) Date of Patent: Aug. 24, 2004

(54) STENCIL

(75) Inventors: Jose M. Martinez, Rocky River, OH (US); Michael D. Bozich, Broadview Heights, OH (US); Christopher Tyra, Avon, OH (US); Martin Homes, Olmstead Falls, OH (US)

(73) Assignee: Henkel Consumer Adhesives, Inc., Avon, OH (US)

( * ) Notice: Subject to any disclaimer, the term of this patent is extended or adjusted under 35 U.S.C. 154(b) by 0 days.

(21) Appl. No.: 10/639,260

(22) Filed: Aug. 12, 2003

(65) Prior Publication Data

US 2004/0118305 A1 Jun. 24, 2004

Related U.S. Application Data

(60) Provisional application No. 60/403,165, filed on Aug. 13, 2002, and provisional application No. 60/408,104, filed on Sep. 4, 2002.

(51) Int. Cl.[7] ..... B41N 1/24; B05C 17/06

(52) U.S. Cl. ..... 101/127; 101/114; 428/137; 156/384

(58) Field of Search ..... 101/127, 114, 101/128.1, 127.1; 33/562, 563, 564, 565, 566; 118/201, 211, 213, 301, 406, 504; 156/384, 388, 277; 428/40.1, 41.8, 131, 137, 68

(56) References Cited

U.S. PATENT DOCUMENTS

| | | | | |
|---|---|---|---|---|
| 2,427,447 A | | 9/1947 | Dicks | |
| 2,438,828 A | | 3/1948 | Sims | |
| 3,665,889 A | | 5/1972 | Waganvcord | |
| 3,929,068 A | | 12/1975 | Budden | |
| 4,024,837 A | | 5/1977 | Snyder | |
| 4,129,669 A | | 12/1978 | Lopez | |
| 5,194,299 A | | 3/1993 | Fry | |
| 6,250,219 B1 | * | 6/2001 | Garvin | 101/129 |
| 6,436,527 B1 | | 8/2002 | Zimmermann | |

FOREIGN PATENT DOCUMENTS

| | | | |
|---|---|---|---|
| BR | 1366343 | | 9/1974 |
| EP | 0307 624 A1 | | 3/1989 |
| NL | 7415295 A | * | 5/1976 |
| WO | WO 03/016041 A1 | | 2/2003 |

OTHER PUBLICATIONS

Encyclopedia of Polymer Science and Engineering, vol. 13 at 345–68 (1988).

* cited by examiner

*Primary Examiner*—Leslie J. Evanisko
(74) *Attorney, Agent, or Firm*—Connolly Bove Lodge & Hutz LLP

(57) ABSTRACT

A stencil in sheet or roll form that is adapted for stenciling large surfaces such as walls or ceilings, particularly when those surfaces are of a delicate nature. The stencil is a laminar structure including an outer layer of a absorbent flexible material such as paper permanently adhered to a flexible barrier layer. On the side of the barrier layer opposite the outer layer is a pressure sensitive adhesive layer that is fixed to the barrier layer, yet temporarily and releasably adheres the stencil to the surface to be decorated. The pressure sensitive adhesive may be covered with a release liner that is easily removed to expose the adhesive for application of the stencil sheet to the surface, and that prior to being removed, permits the stencil sheets to be formed conveniently into a roll or stacked without adhering to itself or one another.

22 Claims, 2 Drawing Sheets

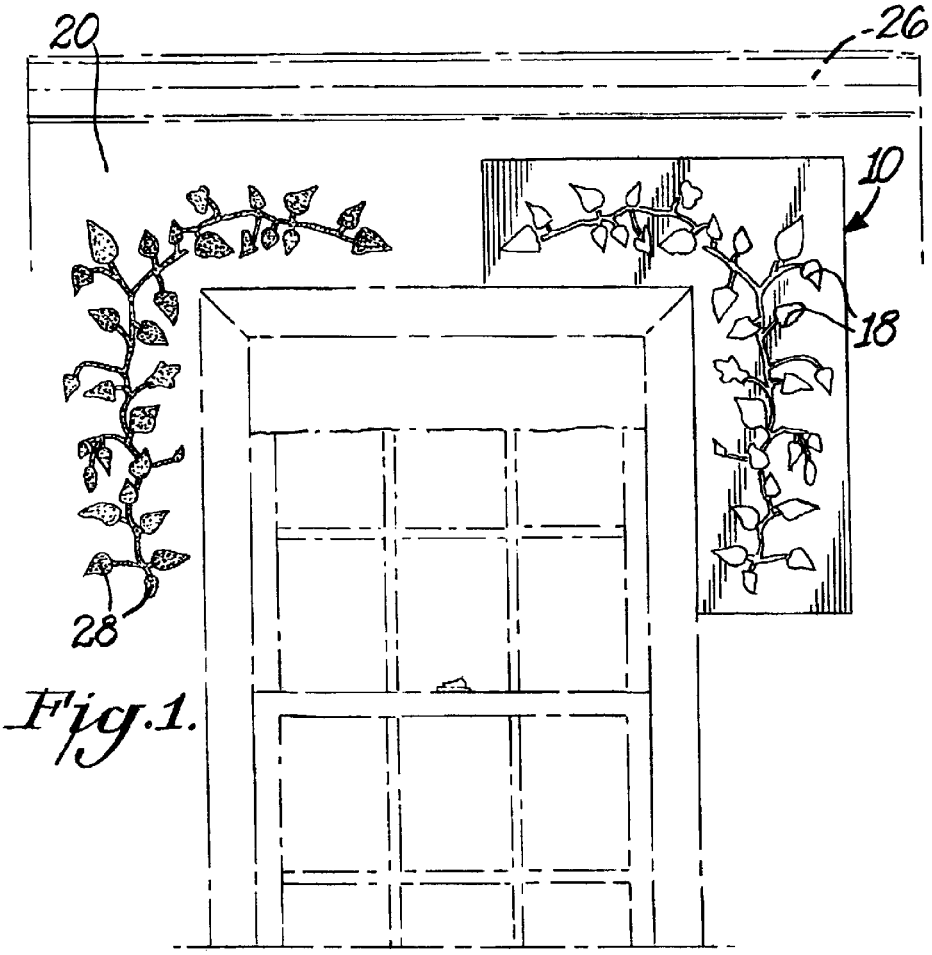
Fig.1.
Fig.2.
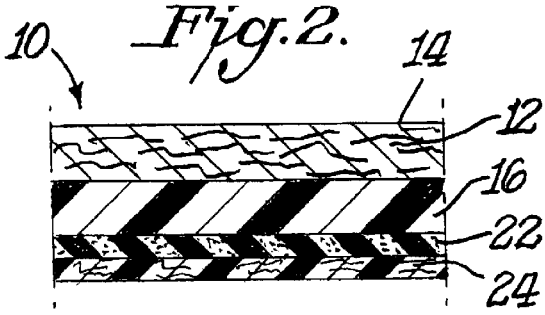

STENCIL

CROSS REFERENCE TO RELATED APPLICATIONS

This application is related to provisional application No. 60/403,165 filed Aug. 13, 2002 and No. 60/408,104 filed Sep. 4, 2002, the benefit of which are claimed pursuant to 35 USC §119.

BACKGROUND OF THE INVENTION

The present invention relates to stencil products for use by painters, decorators, and others, and more specifically, to a stencil for applying decorative designs or patterns on walls, ceilings, furniture, pottery, or other surfaces to be decorated. While the present invention finds particular utility in connection with a stencil product for use by painters or decorators and, accordingly, will be described in detail herein in connection with such use, those skilled in the art will recognize that the invention may have other applications and could be utilized, for example, for arts and crafts and other paint and design related purposes.

Home decorating remains a widespread hobby and a way to economically improve and beautify the home. One continuing area of interest in the field involves decorating interior or exterior walls or trim, ceilings, furniture, pottery, fabrics, dishware, paper, and other surfaces in the home by means of stenciling. In general, stenciling involves first forming a stencil by cutting any desired design or pattern out of a stencil blank, which typically is a strip or sheet of thin, flexible material such as paper or plastic. In addition to custom-made stencils, many pre-cut stencils of endless variations of pattern are available. Once the desired pattern is made or chosen, the stencil is then affixed temporarily by means of tape or adhesive to the surface to be decorated. Paint, ink, or any other desired pigment or coloration is applied over the affixed stencil and adheres to the surface only through the cut-out portions. After the pigment or coloration sets or binds sufficiently to the surface, the stencil is removed, leaving only the desired decorative pattern behind.

Surprisingly, there is little available in the way of stencils that are suitable for convenient use on a large surface, such as a wall or ceiling, and that are at the same time simple in construction and manufacture, and that adhere properly to the surface to be decorated. The present invention therefore provides a new and improved stencil usable in a wide variety of applications.

While many others have attempted to provide effective stencils, the approaches taken have often proved inadequate. A consistent problem with other approaches is assuring a crisp edge to the paint or other coloration applied to the surface underlying the stencil. The following patents describe various approaches to making and using stencils.

U.S. Pat. No. 2,427,447 issued Sep. 16, 1947 describes a stencil sheet having a protective covering or liner over the adhesive surface of the stencil sheet. The liner is made from ridged crepe paper and the stencil from craft paper.

U.S. Pat. No. 2,438,828 issued Mar. 30, 1948 discloses a stencil assembly which facilitates placement of stencil components on the surface to be painted. More particularly, it discloses a stencil sheet with inner 27 and outer 25 cover sheets over the stencil. The outer sheet helps to hold filler pieces in place when applying the stencil to a surface (See column 3, lines 15–22).

Plastic sheeting is used to form the stencil described in U.S. Pat. No. 3,665,889. A cover sheet of readily peelable material overlies the plastic layer (column 1, lines 40–52).

One embodiment of the stencil disclosed in U.S. Pat. No. 3,929,068 issued Dec. 30, 1975 is formed from a laminate of polyethylene between two layers of kraft paper. A release layer overlies the adhesive layer of the stencil laminate. In this stencil, as with many others described herein, kraft paper is in direct contact with the surface to be painted and, as such, is vulnerable to wicking of paint through that paper onto the surface underlying the stencil. The paint absorbed in the paper can cause a distortion of the edges of the stencil cutout as it is applied to the surface.

U.S. Pat. No. 4,024,837 describes a roll of material wound on a cylinder that when unrolled, can be used to apply patterns on a surface, for example, an automobile body. The material can be either paper or plastic (column 2, lines 50–59).

U.S. Pat. No. 4,129,669 issued Dec. 12, 1978 discloses a multilayered stencil comprising a cloth backing closest to the surface which is laminated to a polyethylene film or other waterproof material (column 2, lines 19–40). The patent discloses individual designs across a whole wall (FIG. 5) or other locations, including the ceiling (column 3, line 69-column 3, line 2).

U.S. Pat. No. 6,436,527, which issued Aug. 20, 2002 based on a 1999 application, discloses a particular adhesive useable in stencils and other applications that facilitates removal from a surface by pulling the stencil in a direction parallel to that surface.

A masking tape particularly suitable for masking the corner of a window or other surface to be protected during painting is disclosed in International Publication Number WO 03/016041A1.

British Patent Specification 1,366,343 issued to Roger Norris and published Sep. 11, 1974 discloses a stencil sheet of polyvinylchloride, paint resistant paper or foil with release layers on both sides (page 2, lines 45–60, 100–106).

European Patent No. 0307 624 A1 discloses a paper stencil tape with two cover layers selectively adherent to the stencil so that internal details of patterns can be placed on a surface.

SUMMARY OF THE INVENTION

The present invention provides an improvement for stencils that overcomes the shortfalls of prior stencils and is easy to use. The stencil can be manufactured in well known shapes such as tape or sheets. More particularly, a stencil is provided that is adapted for stenciling surfaces such as walls, ceilings, or around windows, particularly when those surfaces are of a delicate nature. The outer layer of the stencil is comprised of a thin, absorbent, flat, relatively porous material (for example, masking tape, paper, etc.) of any desired size or shape and through which a desired decorative design or pattern may be cut. A flexible liquid barrier, typically a thin layer or film of plastic or polymer material, is permanently adhered to the underside of the outer, porous layer. On the side of the barrier layer opposite the outer layer is a third layer formed of pressure sensitive adhesive that is permanently fixed to the barrier layer, yet suitable to temporarily and releasably adhere or bond the stencil to the surface to be decorated. Lastly, the pressure sensitive adhesive layer may be covered with a release liner or coating that is easily removed to expose the adhesive for application of the stencil to the surface, and that prior to being removed, permits the stencils to be rolled or stacked conveniently without adhering to one another.

The stencil sheet of the invention allows a user to stencil a large surface effectively with minimum effort. The stencil sheet's simple laminar structure is easier to manufacture and offers several advantages over known stencil materials and methods. Because it is conveniently self-adhering, the stencil sheet can be cut easily to any size or shape desired, without measuring, and it can be applied easily to large surfaces without the need to hold, or otherwise affix, sections of stencil as is known from the art. In a particularly preferred embodiment, the stencils are preformed in an L-shape suitable for stenciling on surfaces around the corners of such structures as window and door frames.

In a preferred embodiment, the outer layer is at least somewhat absorptive and therefore draws any excess paint or pigmented liquid that is applied to the stencil away from the cutout in the stencil. The next, or barrier layer inhibits bleeding of any coloration through to the areas of the surface masked by the stencil. In this embodiment, it is especially preferred that the absorbency of the outer layer is such that the paint applied over the stencil is wicked away from the edges of the pattern cut in the stencil. This, coupled with the use of a liquid barrier layer firmly, but removably, adhered to the surface creates a sharply defined outline for the pattern being applied to the wall.

In another preferred embodiment, the pressure sensitive adhesive is selected to provide a firm but releasable adherence for up to thirty (30) days without damaging the underlying surface. Moreover, because the adhesive adheres the stencil firmly to the entire masked surface, seepage of the coloration behind the stencil to the masked portions of the surface is minimized or eliminated.

This invention provides an improved stencil that is economical to produce and use and that enables a user to complete a stenciling operation with well defined edges.

BRIEF DESCRIPTION OF THE DRAWINGS

The invention may take form in certain parts and arrangements of parts, preferred embodiments of which will be described in detail in the specification, and are illustrated in the accompanying drawings, which form a part hereof and wherein:

FIG. 1 is a front elevational view of one embodiment of the invention in which an L-shaped stencil sheet is in place to the right of the illustrated window opening and the finish pattern enabled by the stencil is shown to the left of the window;

FIG. 2 is an enlarged fragmental cross-sectional view showing the several layers of the stencil of this invention;

DESCRIPTION OF PREFERRED EMBODIMENTS OF THE INVENTION

Figure 3:
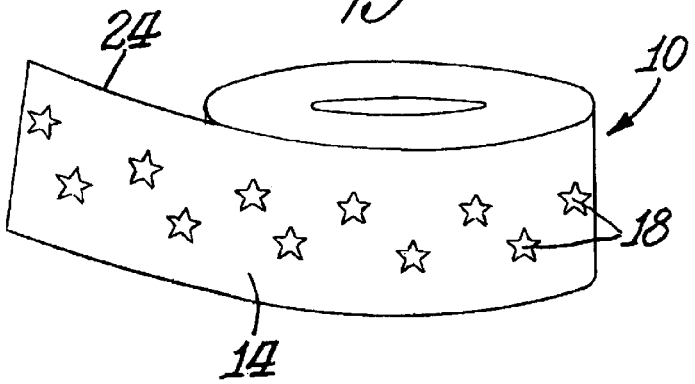
FIG. 3 is a perspective view of a roll of stencil tape according to the present invention.

Referring now in greater detail to the drawings, which are for the purpose of illustrating preferred embodiments of the invention only and not for the purpose of limiting the invention, FIG. 2 shows in cross-section the structure of a stencil according to the invention. The stencil can be made and sold as a flat sheet as shown in FIG. 1, a roll as shown in FIG. 3 or other shapes and sizes as needed.

The outer layer of stencil 10 is a porous sheet 12 that can be of any desired length, width, or shape. Typically, however, and for use in applications to large surfaces, layer 12 will be in the form of sheet, that can be laid flat or formed into a roll.

The outer layer 12 may be coated or uncoated, or otherwise treated or untreated, and may have a thickness of 3 to 30 mils, preferably 5 to 20 mils, and more preferably 5 to 10 mils. In a preferred embodiment, the outer layer 12 is formed of an absorbent paper, for example kraft paper, having a thickness of about 8 mils and a basis weight of about 80 pounds which acts to wick away paint or pigmented liquid from the stencil cutouts 18, for example, by capillary action. The top side 14 of outer layer 12 faces the user when the stencil is affixed to the surface to be decorated, while the opposite or bottom side faces the interior structure of the stencil.

Permanently affixed to the bottom side of outer layer 12 is the barrier layer 16. The outer layer 12 is preferably flat so that it closely adheres to the barrier layer 16. The barrier layer 16 may be formed of any suitable flexible material that is at least relatively impermeable, and preferable totally impermeable, to any pigment, paint, ink, or other coloration applied to the top side 14 of the stencil. The barrier layer 16 functions to inhibit excess coloration applied to the stencil outside the design or pattern cutouts 18 from passing through the stencil 10 to the masked surface 20 beneath the stencil. The barrier layer 16 stops paint or pigmented liquid that passes through the somewhat porous outer layer 12 from reaching surface 20 beneath the stencil 10. Suitable barrier materials include many plastics and polymers. Polyolefins such as polyethylene and polypropylene are suitable, as well as other polymers such as polyethylene terephthalate (PET) sold by E. I. duPont deNemours and Co. under its MYLAR® trademark. The barrier layer typically has a thickness 3 to 15 mils, preferably 5 to 10 mils. In a preferred embodiment, the barrier layer comprises a polyethylene film having a thickness of about 7.5 mils. The barrier layer 16 may be bonded to outer layer 12 with any suitable adhesive that provides a strong, relatively permanent and flexible bond.

On the side of the barrier layer 16 opposite the outer layer 12 is a layer of pressure sensitive adhesive 22. The pressure sensitive adhesive layer 22 is relatively permanently fixed to the barrier layer 16, either by means of the adhesive 22 itself forming such a bond with the barrier layer 16, or by means of an additional adhesive in the adhesive layer 22. Various means of securing a layer of pressure sensitive adhesive to a substrate are well known to those in the adhesive art and need not be repeated here.

While adhering strongly to the barrier layer 16, the pressure sensitive adhesive 22 is suitable to firmly, but temporarily and releasably, adhere or bond the stencil 10 to the surface 20 to be decorated. Firm adherence of barrier layer 16 to surface 20 helps inhibit migration of paint or pigmented liquid under barrier layer 16 which could blur the stencil pattern. Conversely, easy removal of the stencil is important to permit reuse of stencil 10 and avoid damage to surface 20 when the stencil 10 is removed from that surface. Suitable adhesive materials are low tack solvent rubber adhesives as well as low-tack acrylic-based adhesives. Suitable pressure sensitive adhesives are described in, for example, the *Encyclopedia of Polymer Science and Engineering.* Vol. 13 at 345–68 (1988) and the references cited therein, including pressure sensitive adhesives based on natural rubber, polystyrene/polydiene block copolymers, styrene/butadiene rubber, polyisobutylene, ethylene/vinyl acetate copolymers, vinyl acetate copolymers, silicone polymers, and poly (vinyl alkyl ether)s. Other suitable adhesives are described in U.S. Pat. No. 5,194,299, the entire disclosure of which is incorporated herein by reference. In one preferred embodiment, the pressure sensitive adhesive 22 is capable of firmly but releasably affixing the stencil 10 to the surface 20 for up to seven days. In another preferred embodiment, the pressure sensitive adhesive 22 is capable of firmly but releasably affixing the stencil 10 to the surface 20 for up to one month without damaging even delicate surfaces when removed. This affords the user the added advantage of being able to work intermittently on a large project without fear of the stencil moving or damaging the underlying surface. This adhesive 22 also permits reuse of the stencil several times before the adhesive looses its hold on surface 20.

Lastly, the pressure sensitive adhesive layer 22 may be covered with a release liner or layer 24 that is easily removed to expose the adhesive for application of the stencil 10 to the surface 20, and that prior to being removed, permits the stencil to be formed.conveniently into a roll or to be stacked without adhering to itself or another sheet. Preferably, the release layer 24 comprises a paper having a thickness of 1 to 5 mils, preferably about 3 mils. The paper preferably is a coated paper, such as wax paper and the like, which are known in the art for use as release coatings. The overall thickness of the stencil 10 may be at least about 10 mils and up to about 30 mils, but greater and lesser thickness are possible.

As is shown in FIG. 1, the stencil sheet 10 is illustrated as a flat sheet with pre-cut decorative patterns or designs 18; in the embodiment shown, this is a floral pattern. This Figure also illustrates one embodiment of the stencil 10 of this invention which is suitable for stenciling around corners of windows or doors.

Figure 4:
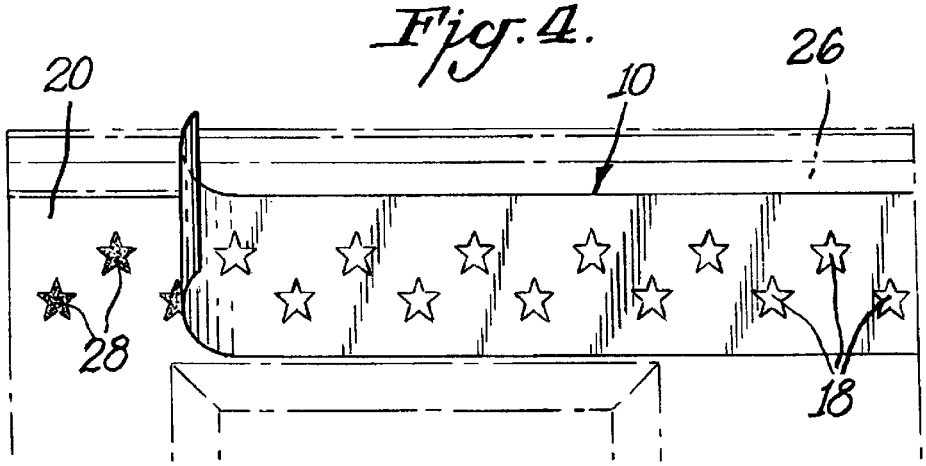
FIG. 4 illustrates application of a stencil masking tape according to the invention to a wall below a crown moulding and above a window casing.

FIGS. 3 AND 4 illustrate another embodiment of the invention particularly suited for applying a linear display of a decorative pattern, for example, the star pattern illustrated in these Figures. In this embodiment, the stencil 10 is provided to the user in a roll or tape form (FIG. 3). The release layer 24 on one side of the stencil tape 10 allows the stencil 10 to be wound on itself in a roll without any sticking between layers of the stencil. FIG. 4 illustrates application of the stencil tape 10 on a surface (wall) 20 adjacent crown molding 26 at the juncture of the wall and ceiling. The release layer 24 is, of course, removed before application of the stencil 10 to wall 20 to assure adherence of the stencil to the wall. After putting the stencil 10 on wall 20, paint or other colorant is applied over the stencil, particularly over the patterned cutouts 18 in stencil 10. As shown in FIGS. 1 and 4 when the stencil is lifted from wall 20 the pattern 28 formed by cutouts 18 is left on surface 20. The edges of the pattern 28 are particularly well defined and sharply delineated utilizing the features of this invention individually or in combination, namely, a paper or other absorbent outer layer 12, a flexible, impermeable barrier layer 16 and an adhesive layer 22 that holds the stencil tight to surface 20.

As one of skill will appreciate, the stencil patterns can be made by any suitable means, such as die cutting. In order for the stencil 10 to function properly, the openings 18 in stencil 10 must pass through at least the outer layer 12, barrier layer 16 and pressure sensitive adhesive layer 22 of the stencil to allow the decorative patterns to be affixed to the surface 20. Accordingly, for ease of manufacture, the outer layer 12, barrier layer 16 and adhesive layer 22 can be formed as a composite material, after which the decorative pattern 18 can be die-cut through the whole assembly. Thereafter, the release layer 24 can be applied to facilitate transport of the stencil While emphasis has been placed on the structures and configuration of the preferred embodiments of the invention illustrated in the figures, it will be appreciated that other embodiments, as well as modifications of the embodiments disclosed herein, can be made without departure from the principles of the invention. In this respect, it will be appreciated that the stencil sheet can be used in other kinds of applications. These and other modifications of the preferred embodiments, as well as other embodiments of the invention, will be suggested to those skilled in the art from the disclosure herein, whereby it is to be distinctly understood that the foregoing descriptive manner is to be interpreted merely as illustrative of the present invention and not as a limitation thereof.

What is claimed is:

1. A stencil for applying a patterned design to a surface comprising a) a first outer absorbent layer having a top side facing away from the surface and a bottom side facing the surface when applied to the surface;

b) a second flexible, substantially impervious barrier layer having a top side adhered to the bottom side of the outer layer and a bottom side facing the surface;

c) a third pressure sensitive adhesive layer having a top side permanently adhered to the bottom side of the barrier layer and a bottom side that can be firmly, but temporarily and releasably, adhered to the surface, wherein openings in the stencil corresponding to the patterned design extend through the first through third layers.

2. The stencil of claim 1 wherein a fourth release layer is removably adhered to the bottom side of the pressure sensitive adhesive layer prior to application of the stencil to the surface.

3. The stencil of claim 2, wherein the release layer comprises a paper having a thickness of 1 to 5 mils.

4. The stencil of claim 3, wherein the release layer comprises a coated paper.

5. The stencil of claim 4, wherein the release layer is wax paper.

6. The stencil of claim 4, wherein the coated paper has a thickness of about 3 mils.

7. The stencil of claim 2, wound into a roll.

8. The stencil of claim 1 wherein the outer absorbent layer comprises paper.

9. The stencil of claim 8, wherein the outer layer is flat paper stock having a basis weight of about 80 pounds.

10. The stencil of claim 1 wherein the outer absorbent layer draws liquid colorants applied to the stencil away from the openings in the stencil.

11. The stencil of claim 1 wherein the outer layer has a thickness of 3 to 30 mils.

12. The stencil of claim 11, wherein the outer layer has a thickness of 5 to 20 mils.

13. The stencil of claim 11, wherein the outer layer has a thickness of 5 to 10 mils.

14. The stencil of claim 1, wherein the barrier layer comprises a plastic or polymer film.

15. The stencil of claim 14, wherein the barrier layer comprises a polyolefin film.

16. The stencil of claim 14, wherein the barrier layer has a thickness of 3 to 15 mils.

17. The stencil of claim 16, wherein the barrier layer has a thickness of 5 to 15 mils.

18. The stencil of claim 14, wherein the barrier layer comprises a polyethylene film.

19. The stencil of claim 18, wherein the film has a thickness of about 7.5 mils.

20. The stencil of claim 1, wherein the pressure sensitive adhesive layer comprises a low tack solvent rubber adhesive.

21. The stencil of claim 1, having an L-shape adapted for application to a surface around the corner of a window or door.

22. The stencil of claim 1, wherein the pressure sensitive adhesive layer comprises a low-tack acrylic-based adhesive.

* * * * *

UNITED STATES PATENT AND TRADEMARK OFFICE

CERTIFICATE OF CORRECTION

PATENT NO. : 6,779,443 B2
DATED : August 24, 2004
INVENTOR(S) : Jose Martinez et al.

It is certified that error appears in the above-identified patent and that said Letters Patent is hereby corrected as shown below:

Column 6,
Line 67, "5 to 15 mils" should read -- 5 to 10 mils --.

Signed and Sealed this

Eighteenth Day of January, 2005

JON W. DUDAS
*Director of the United States Patent and Trademark Office*